United States Patent [19]

Fisher et al.

[11] Patent Number: 4,892,782

[45] Date of Patent: Jan. 9, 1990

[54] FIBROUS MICROWAVE SUSCEPTOR PACKAGING MATERIAL

[75] Inventors: John R. Fisher, Hockessin, Del.; Hua-Feng Huang, Mendenhall, Pa.

[73] Assignee: E. I. DuPont de Nemours and Company, Wilmington, Del.

[21] Appl. No.: 37,987

[22] Filed: Apr. 13, 1987

[51] Int. Cl.[4] ..... B32B 5/16

[52] U.S. Cl. ..... 428/240; 428/242; 428/244; 428/283

[58] Field of Search ..... 428/240, 242, 244, 283

[56] References Cited

U.S. PATENT DOCUMENTS

| | | | |
|---|---|---|---|
| 3,591,400 | 7/1971 | Palmquist et al. | 117/3.3 |
| 4,190,757 | 2/1980 | Turpin et al. | 219/10.55 E |
| 4,204,105 | 5/1980 | Leveckis et al. | 219/10.55 E |
| 4,230,924 | 10/1980 | Brastad et al. | 219/10.55 E |
| 4,267,420 | 5/1981 | Brastad | 219/10.55 E |
| 4,434,197 | 2/1984 | Petriello et al. | 427/407.1 |
| 4,515,850 | 5/1985 | Ishino et al. | 428/225 |
| 4,518,651 | 5/1985 | Wolfe, Jr. | 428/308.8 |

FOREIGN PATENT DOCUMENTS

| | | |
|---|---|---|
| 3146235 | 5/1983 | Fed. Rep. of Germany . |
| 60-018340 | 1/1985 | Japan . |

*Primary Examiner*—Marion C. McCamish

[57] ABSTRACT

New composite materials useful for wrapping food items to be cooked by microwave energy comprise drapable, liquid permeable, woven or non-woven, fibrous dielectric substrates, which substrates, or fibers of which substrates, are coated and/or imbibed with one or more susceptor materials. The composite materials, when wrapped around a food item to be cooked by microwave energy, enhance the browning and/or crispening of the items.

15 Claims, No Drawings

FIBROUS MICROWAVE SUSCEPTOR PACKAGING MATERIAL

BACKGROUND OF THE INVENTION

This invention relates to materials useful for enhancing the browning, crisping, flavor and aroma of foods cooked in microwave ovens.

Food preparation and cooking by means of microwave energy has, in recent years, become widely practiced as convenient and energy efficient. Microwave cooking of precooked and uncooked food products has traditionally produced bland-appearing and soggy meats and pastry goods. To alleviate this problem and aid the browning and crispening of the surface of a cooked food item, there have been developed a number of packaging materials specially adapted for use in microwave cooking. Many such known packaging materials incorporate a microwave susceptor material, i.e., a material capable of absorbing the electric or magnetic portion of the microwave field energy to convert that energy to heat.

U.S. Pat. No. 4,267,420 to Brastad discloses a packaging material which is a plastic film or other dielectric substrate having a thin semiconducting coating. A food item is wrapped in the coated film so that the film conforms to a substantial surface portion of the food item. On exposure to microwave energy, the film converts some of that energy into heat which is transmitted directly to the surface portion so that a browning and/or crispening is achieved.

U.S. Pat. No. 4,518,651 to Wolfe discloses flexible composite materials exhibiting controlled absorption of microwave energy comprising a porous dielectric substrate coated with electrically conductive particles, such as particulate carbon, in a thermoplastic dielectric matrix. The porous substrate is a sheet or web material, usually paper or paperboard. The patent implies that the porosity of the substrate is necessary so that the susceptor/thermoplastic matrix is adequately absorbed.

U.S. Pat. No. 4,434,197 to Petriello et al. discloses a flexible multi-layer structure having at least one layer colored with a pigment and/or energy absorber with the outer two layers consisting of pure polytetrafluoroethylene to provide a food contacting surface. Disclosed as suitable energy absorbers are colloidal graphite, carbon and ferrous oxide.

U.S. Pat. No. 4,230,924 to Brastad et al. discloses a flexible wrapping sheet of dielectric material, such as polyester or paperboard, capable of conforming to at least a portion of the shape of a food article, and having a flexible metallic coating thereon. The coating, e.g., of aluminum, chromium, tin oxide, silver or gold, converts a portion of microwave energy into thermal energy so as to brown or crispen that portion of the food adjacent thereto.

The above-cited patents all disclose flexible materials used for wrapping around a food item to achieve browning and crispening during microwave cooking. An alternate approach was suggested in U.S. Pat. No. 4,190,757 to Turpin et al. This patent discloses a paperboard carton having a lossy microwave energy absorber which becomes hot when exposed to microwave radiation. The package also preferably includes a shield, e.g., a metal screen or a metal foil cover having holes therein, to reduce by a controlled amount the direct transmission of microwave energy into the food product. The patent notes that, as heating occurs, moisture vapor and steam is vented through the openings in the shield, thereby maximizing the opportunity for moisture to be driven out of the food product and for the food product to become crisp.

Another patent which recognizes the desirability of providing in microwave packaging materials a means for removing liquid by-products is U.S. Pat. No. 4,390,554 to Levinson. Unlike the preceding patents, however the goal of the '554 patent was not to achieve browning and crispening of a food but to overcome spot, selective and edge heating. Also unlike the preceding patents, the packaging system of the '554 patent does not utilize a microwave susceptor material. In the disclosed packaging system, a food item is enclosed in and contacted by a perforated plastic film which in turn is enclosed in a microwave-permeable, water and food by-product absorptive material, all of which are enclosed by a microwave-permeable, liquid-barrier plastic film, all of which are enclosed by a microwave-permeable, heat-insulating material. The absorptive material absorbs liquid escaping during cooking and then itself becomes microwave absorptive, reducing the amount of microwave energy reaching certain areas of the food.

As the above-mentioned patents indicate, there has been no shortage of proposed packaging materials for ameliorating the problems inherent in microwave cooking. Despite all of these efforts, and a number of packaging materials currently available for packaging foods for microwave cooking, it is generally recognized in the trade that certain types of foods are extremely difficult to cook satisfactorily by microwave. These foods are foods which should ideally have a browned or crispened exterior and a moist interior such as egg rolls, fish sticks, french fries, fried chicken and dough-type products. The present invention relates to new packaging materials which can be used to package a variety of foods for microwave cooking, which can enhance the crisping, browning, flavor and aroma of the packaged foods when cooked by microwave without substantially lengthening the required cooking time, and are especially useful for packaging and cooking the aforementioned "difficult" foods.

SUMMARY OF THE INVENTION

The new composite materials of this invention comprise drapable, liquid permeable, woven or non-woven, fibrous dielectric substrates, which substrates, or fibers of which substrates, are coated and/or imbibed with one or more susceptor materials. By virtue of their being drapable, the composite materials of this invention are capable of conforming substantially to the shape of the food item to be browned or crispened. The susceptor material thereon converts a portion of the incident microwave radiation to heat which imparts rapid browning and/or crispening to the heat exterior surface of the wrapped food item without impeding appreciably the rate at which the interior regions of the food item is heated. The composite material also allows moisture evolved during heating of the food item to readily escape as vapor, thereby aiding and hastening browning and crispening of the food surface.

DETAILED DESCRIPTION OF THE INVENTION

One feature distinguishing the composite material of this invention from the composite susceptor materials known in the art is their permeability to liquids. For the purpose of this invention, liquid permeability is defined as the ability of the composite material to absorb and transmit liquids, as further described below. When many of the prior art microwave packaging materials (e.g., susceptor-coated films) are used to wrap foods for microwave cooking, the moisture evolved during cooking is driven back into the interior of the food, or allowed to collect at the inner surface of the packaging material. In contrast, when the composite materials of this invention are used, the surface moisture escapes to the pore area of the fabric where it can couple with the incident electromagnetic field and rapidly evolve as vapor to the environment as the susceptor heats up to temperatures above that of the food. The result is that the food surface becomes dry so that it can be browned and crisped under the influence of the higher temperature material nearby. Thus, faster cooking rates and a more pleasing result can be achieved using the composite materials of this invention as opposed to susceptor films of the prior art.

The fibrous substrates useful in this invention may be woven or nonwoven. Nonwoven materials include spunbonded or spunlaced products. The substrates may be made from such fibrous materials including but not limited to cotton, cellulose, jute, hemp, acetate, fiberglass, wool, nylon, polyester, aramid, polypropylene, and other polyolefins. Examples of suitable substrates include woven cotton cloth, paper, rayon, "Dacron" polyester, cloths woven of "Nomex" or "Kevlar" aramid fibers, "Sontara" spunlaced fabric, "Typar" spunbonded polypropylene, "Tyvek" spunbonded olefin sheets and "Reemay" spunbonded polyester. ("Dacron", "Nomex", "Kevlar", "Sontara", "Typar", "Tyvek", and "Reemay" are all trademarks of E. I. du Pont de Nemours and Company, Wilmington, Delaware.) Of course, the substrate should be a material which has sufficient thermal and dimensional stability at the high temperatures which may be desired for browning foods in a microwave oven, generally as high as 110 degrees C. and above, and often as high as 175 degrees C. and above. High temperature-resistant or non-melting fibrous substrates such as cotton, paper or fiberglass fabrics are preferred because they are more likely to withstand the high temperatures achieved during microwave cooking.

For rapid browning/crispening, it is important that the evolved moisture from the food product be vaporized rapidly. It is believed that this is achieved by maximizing, to the extent possible, both the heat transfer surfaces of the composite material (to facilitate a large susceptor-activated surface for generating high heat flux) and the mass transfer surface of the composite material (i.e., maximizing the openings through which moisture can escape). Obviously, these two goals compete with one another. To increase the heat transfer surfaces of the composite material, i.e., maximize the susceptor-activated surface for generating high heat flux, one might increase the denier of the fibers in the substrate and increase the thread count of the substrate so that there is more area on which to apply susceptor. To maximize the mass transfer surface of the composite material, i.e., maximize its ability to absorb and transmit moisture, one might decrease the denier of the fibers in the substrate and the thread count in a woven substrate and increase its thickness. The characteristics of the optimal substrate material must thus be determined by balancing these competing needs as well as the requirement that the substrate be drapable. Generally, the substrate material will have a thickness greater than about 3 mils, preferably between about 9 and 40 mils.

As previously mentioned, the susceptor materials which are coated onto and/or imbibed into the substrate, or fibers of the substrate, are materials which are capable of absorbing the electric or magnetic field components of the microwave energy to convert that energy to heat. Many such materials are known in the art and include metals such as nickel, antimony, copper, molybdenum, bronze, iron, chromium, tin, zinc, silver, gold, aluminum, and ferrites, and alloys such as stainless steel (iron, chromium, nickel alloy), nickel/iron/molybdenum alloys (e.g., Permalloy), nickel/iron/copper alloys (e.g., Mu-metal), and iron/nickel alloys (e.g., Hypernick), all of which may be used in particulate, short fiber or flake form. Certain naturally occuring microwave susceptive food ingredients or flavors such as poly and mono- saccharides (e.g., molasses, honey, maple syrup, caramel, sucrose, fructose, lactose, and glucose) and ionically conductive flavoring agents (e.g., salted oil and butter, certain sauces) may also be used as the susceptor material in the composites of this invention. Other suitable susceptor materials conductive polymers such as polyaniline, are polypyrrole, and tetrathiafulvalene:tetracyanoquinodimethane. Ionic conductors such as sodium chloride or perfluorocarbon ion exchange polymers may also serve as susceptor materials. Combinations of susceptor materials may be used, e.g., a mixture of metals or alloys, or a mixture of a metal with a susceptive food ingredient.

In a preferred embodiment, the susceptor material is one which responds to both the electric components of the incident and the magnetic field microwave radiation, as disclosed in copending application U.S. Ser. No. 07/037/988, filed simultaneously herewith now U.S. Pat. No. 4,833,007, the disclosure of which is hereby incorporated by reference. In another preferred embodiment, the susceptor material is in flake form and is preferably aluminum, as disclosed in copending application U.S. Ser. No. 002980, filed January 23, 1987, the disclosure of which is hereby incorporated by reference. As that copending application discloses, the flake susceptor material (having a ratio of the largest dimension of its face to its thickness of at least about 10) may be dispersed in a thermoplastic dielectric matrix, e.g., a polyester copolymer. The susceptor level in the thermoplastic matrix will generally range from about 5 to 80% by weight of the combined susceptor/matrix. A solution of the susceptor/matrix may be applied to the substrate material by any number of coating or printing processes, e.g., as by gravure printing. To achieve best results, the susceptor coating should be uniform and isotropic.

The susceptor materials may be applied to the substrate by a number of methods. They may be applied directly to the fibers from which the substrate is made, for example in the extrusion process or later as a finish application prior to weaving or forming into substrate materials. In the case of synthetic fibers, the susceptor may be imbibed in the polymer spinning solution before the solution is spun into fiber. Finally, the susceptor may be applied to the final woven or nonwoven substrate using methods including but not limited to vacuum chemical vapor deposition, vacuum metallization, radio frequency sputtering, printing and electrolytic processes or baths. It is believed that the heating capacity and moisture permeability of the composite material, as well as its ability to transmit microwave energy, is enhanced when multifilament fibers are treated with the susceptor material (in contrast with mono-filament fiber or the finished substrate material itself). It is believed that this is so because of the increased coated surface area. Enhanced heating capacity and moisture removal should lead to better control of the heating and browning of the surface of the wrapped food item while increased microwave transmission should shorten the time needed to cook the interior of the food.

The quantity of susceptor applied to the substrate should be sufficient to rapidly raise the temperature of the composite material to temperatures which will aid the browning and crispening of the adjacent food surface but should also not substantially impede the ability of microwave energy to penetrate into the food item being cooked. In other words, food items wrapped in the composite materials of this invention should be capable of being cooked, browned and/or crispened by microwave energy in substantially less time than it would take to cook the same item in a conventional oven. Controlling the thickness of the susceptor in relation to the microwave skin depth at microwave oven frequencies allows a proper balance between reflection, absorption, and transmission of electromagnetic energy at or near the food surface. This optimizes the surface heating for crisping and browning as well as the amount of microwave energy transmitted through the composite material so as to avoid over or under cooking of the interior portion of the food. The amount of susceptor coated on or imbibed in the substrate will generally be an amount less than that equivalent to about twice the microwave skin depth.

Various methods may be used to measure the amount of susceptor coated on or imbibed in the fibrous substrate. No one method is suitable for quantifying the amount of susceptor used in all of the composites of this invention, however. To quantify the amount of metal coated on a film, for example, D.C. surface resistivities are commonly used. Direct surface resistivity measurements cannot be used to quantify the amount of susceptor material coated onto one side of certain fibrous substrates of this invention, e.g., woven materials, since, by virtue of the open spaces between the fibers, the coating layer is not continuous. On the other hand, if the woven fibrous substrate (or fibers thereof prior to weaving) had been immersed in the susceptor material, so that the fibers are imbibed with or completely coated with susceptor material, it is possible to directly measure the surface resistivity of the composite material.

Two methods for quantifying the amount of susceptor in or on a substrate have been used in those instances where direct surface resistivities cannot be measured. In both of these methods, measurements are made on polyester film coated with an amount of susceptor equivalent to that on the fibrous substrate. One method measures the amount of visible light transmitted through 92 gauge polyester film coated with susceptor, and another measures the surface resistivity of polyester film coated with susceptor. Thus, for example, one can quantify the amount of susceptor on a fibrous substrate by equating it to the amount of susceptor which will, when coated onto polyester film, lead to a film with a certain specified Percent Visible Light Transmission (% VLT) or surface resistivity. Work to date indicates that, for the composites of this invention, amounts of susceptor leading to composites having direct or equivalent surface resistivities in the range of about 12 to 5000 ohms/square are useful. Depending on the end use for the composite material, and the wide range of powers of microwave ovens, it is probable that the range of utility could be even broader, e.g., from 0.4 to 10,000 ohms/square. Resistivities in excess of 20,000 ohms/square are not easily defined because of the inaccuracy of the test. In the case of all susceptor materials, but especially some of the sugar containing materials such as molasses which tend to form continuous films, it is important that the amount of susceptor not be so great as to adversely affect the liquid permeability of the composite material.

It should be noted that a third method, useful in some instances, for determining the amount of susceptor involves the use of a quartz oscillator thickness gauge, where the frequency of vibration changes with the amount of metal deposited onto the substrate.

Guidelines that establish which heating rates and thermal equilibrium limits are appropriate for wrapping a particular food stuff are dependent upon microwave oven heating power, the type of microwave oven, the kind and state of the foodstuff (e.g., frozen, refrigerated, dry) and the softening point, if any, of the substrate portion of the composite material. Some of the composite materials of this invention may be repeatedly used as food wraps for exposure in microwave ovens.

An advantage of the liquid permeable composite materials of this invention, in addition to their ability to be used as a packaging material to enhance browning and crisping of a food item, is their ability to absorb and carry certain liquid aroma and flavor enhancing agents such as, for example, cooking oils, sauces, honey, molasses, or syrups. Tests indicate, for example, that an egg roll wrapped in a composite material according to this invention to which cooking oil has been applied (e.g., by coating onto the composite material, or soaking the composite material in oil) and cooked in a microwave oven more nearly approaches the texture, flavor and aroma of a deep fat fried egg roll than egg rolls cooked in a composite material which has not been oil treated.

Since the liquid permeability of the composite materials of this invention is an important feature, two tests have been devised in an attempt to quantify the liquid permeability of a material, i.e., its ability to absorb and transfer moisture:

TEST FOR MOISTURE TAKE-UP

A 1-inch by 1-inch sample of composite material is weighed for its initial weight, dipped into room temperature water for ten seconds, patted dry with a cloth towel, and then reweighed. Moisture pickup in milligrams per square centimeter is calculated.

TEST FOR MOISTURE TRANSMISSION RATE

A 70 gram aliquot of water is placed in a glass bottle (1-11/16" I.D. opening at the top, 2½" I.D. bottom, 5" high), and the bottle is then covered with a sample of composite material. (If the substrate of the composite material is coated with susceptor material on only one surface, the coated surface is placed face down on the bottle, facing the water.) The covered bottle is placed in a nominal 700 watt, one cubic foot microwave oven (such as an Amana Mastercook Model RR-1220 or a Sharp Carousel II Model 8260) at full power for two minutes. Loss in weight of the water and gain in weight of the fabric are measured to compute the amount of water absorbed by the composite material per minute and, thus, the amount of water transmitted per minute through the composite material.

Moisture takeup and moisture transmission rate data for various composite materials according to this invention are presented in Tables 1 and 2, respectively. Information regarding the substrates and susceptors referred to in Tables 1 and 2, as well as in later examples, is presented in Tables 3 and 4.

TABLE 1

Moisture Takeup of Composite Materials

| Substrate | Coated With | Moisture Takeup mg/cm$^2$ |
|---|---|---|
| "Mylar" polyester film | metallized with 256 ohm/square of stainless steel SS304* | 0.0 |
| coarse cotton | 63 ohm/square equivalent of stainless steel SS304* | 9.3 |
| fine cotton | No coating | 1.6 |
| glass fiber | 63 ohm/square equivalent of stainless steel SS304* | 23.3 |
| "Kevlar" aramid, woven | 63 ohm/square equivalent of stainless steel SS304* | 24.8 |
| "Kevlar" aramid, woven | polyaniline conductive polymer** | 14.0 |
| "Kevlar" aramid, spunlaced | polyaniline conductive polymer** | 25.7 |
| "Dacron" polyester, woven | 63 ohm/square equivalent of stainless steel SS304* | 15.5 |
| "Dacron" polyester, woven | polyaniline conductive polymer** | 20.0 |
| "Reemay" spunbonded polyester | 250 angstrom Permalloy | 1.5 |
| "WypAll" paper | No coating | 18.6 |
| "Softnet" papernet, medium weight | No coating | 4.7 |
| Fine cotton | Aluminum flake*** | 1.6 |

*Substrates were vacuum metallized; the amount of coating (mg/sq. cm.) was equivalent to that required to achieve a vacuum metallized polyester film with the indicated surface resistivity, e.g., 63 ohm/square.
**Substrates were immersed in conductive polymer solution
***A coating of 60% aluminum flake (Aluminum flake S3641, Silberline Manufacturing Company, Lansford, Pennsylvania) dispersed in a polyester copolymer medium (28% total solid in THF/toluene solvent) was gravure printed onto the substrate, in two passes using a #33 Trihelical engraving roll. "Mylar", "Reemay", "Dacron", and "Kevlar" are registered trademarks of E. I. du Pont de Nemours and Company, Wilmington, Delaware, USA. "WypAll" is a product of Scott Paper Company, Philadelphia, Pennsylvania, USA. "Softnet" is a product of Johnson & Johnson Products, Inc., New Brunswick, New Jersey, USA.
Tables 3 and 4 provide more information regarding the substrate and susceptor materials.

TABLE 2

Moisture Transmission Rate for Composite Materials

| Composite | Moisture Transmitted (mg/sq. cm/min.) | Moisture Absorbed (mg/sq. cm/min.) |
|---|---|---|
| Fine cotton, uncoated | 359.6 | 0.8 |
| Fine cotton, SS304, 14% VLT* | 317.8 | 2.0 |
| Fine cotton, SS304, 8% VLT* | 362.7 | 0.6 |
| Fine cotton, SS304, 2% VLT* | 324.0 | 0.5 |
| Coarse cotton, uncoated | 373.6 | 1.9 |
| Coarse cotton, SS304, 14% VLT* | 325.5 | 2.2 |
| Coarse cotton, SS304, 8% VLT* | 334.8 | 1.9 |
| Coarse cotton, | 308.5 | 1.9 |

TABLE 2-continued

Moisture Transmission Rate for Composite Materials

| Composite | Moisture Transmitted (mg/sq. cm/min.) | Moisture Absorbed (mg/sq. cm/min.) |
|---|---|---|
| SS304, 2% VLT* | | |
| "Reemay" spunbonded polyester, uncoated | 409.2 | 4.8 |
| "Kevlar" aramid spunlaced, uncoated | 322.4 | 2.0 |
| "WypAll" paper, uncoated | 235.6 | 1.1 |
| "Softnet" papernet, medium weight, uncoated | 238.0 | 0.3 |
| "Dacron" polyester woven, uncoated | 370.5 | 2.5 |
| Glass fiber, woven, uncoated | 269.7 | 1.4 |
| Fine cotton, Aluminum flake** | 330.2 | 1.7 |

*Substrates were vacuum metallized; the amount of coating (mg/sq. cm) was equivalent to that required to achieve a vacuum metallized 92 gage thick polyester film with the indicated % VLT (Percent Visible Light Transmission). The higher the % VLT, the lighter is the metal coating weight, e.g., 2% VLT is heavy, 8% VLT is medium, and 14% VLT is light coating weight.
**A coating of 60% aluminum flake (Aluminum flake S3641, Silberline Manufacturing Company, Lansford, Pennsylvania) dispersed in a polyester copolymer medium (28% total solid) was gravure printed onto the substrate, in two passes using a #33 Trihelical engraving roll.

TABLE 3

Description of Substrate Materials

| Type | Count | Thickness (mils) | Weight (oz/sq. yd) | Manufacturer | Style No. |
|---|---|---|---|---|---|
| Woven Substrates: | | | | | |
| "Dacron" polyester | 19 × 19 | 12 | 1000 | J P Stevens | 29005 |
| Coarse Cotton | 23 × 20 | 31 | 9.0 | W P Pepperell | 14-1002-20 |
| Fine Cotton | 64 × 65 | 10 | 2.6 | Staple Sewing Aids | 1603 |
| "Kevlar" aramid | 17 × 17 | 10 | 5.0 | Du Pont | 281 |
| Fiberglass | 16 × 14 | 12 | 9.6 | Hi-Pro-Form | 1800 |
| Non-woven Substrates: | | | | | |
| "Reemay" spunbonded polyester | | 11.3 | 2.0 | Du Pont | — |
| "Kevlar" spunlaced aramid | | 15.2 | 2.0 | Du Pont | — |
| "WypAll" paper | | 22.1 | 2.7 | Scott | 057005 |
| "Softnet" | | 9.5 | 1.3 | Johnson & Johnson | HRI8137-4121 |

TABLE 4

Susceptor Materials

| Metal | Stainless Steel SS304 | Stainless Steel SS316 | Permalloy 4-79 | Mu-Metal | Aluminum |
|---|---|---|---|---|---|
| COMPOSITION (%) | | | | | |
| C | 0.08 | 0.08 | | | |
| Mn | 2. | 2. | 0.3 | | |
| P | 0.045 | 0.045 | | | |
| S | 0.03 | 0.03 | | | |
| Si | 1.0 | 1.0 | | | |
| Cr | 18./20. | 16./18. | | 2. | |
| Ni | 8./12. | 10./14 | 79. | 75. | |
| Mo | | 2./3. | 4. | | |
| Cu | | | | 5. | |
| Fe | balance | balance | bal- | bal- | |

TABLE 4-continued

| Metal | Susceptor Materials: Stainless Steel SS304 | Stainless Steel SS316 | Permalloy 4-79 | Mu-Metal | Aluminum |
|---|---|---|---|---|---|
| | | | ance | ance | |
| Al | | | | | 100 |
| Bulk Resistivity (microhm-cm) | 72. | 74. | 55. | 62. | 2.7 |
| Permeability @20 gausses | | | 20K | 20K | |

Tabulated from CRC Handbook of Chemistry and Physics, 55th Ed.

For the purposes of this invention, composite materials with a moisture takeup, measured as described above, of at least 0.5 mg/sq. cm, preferably of at least 1.0 mg/sq. cm, and with a moisture transmission rate, also measured as described above, of at least 50 mg/sq. cm/min., preferably at least 200 mg/sq. cm/min., are preferred.

To use the composite materials of this invention, one wraps a food item to be cooked in the composite material in such a way that the composite material conforms substantially to the shape of the food item and is substantially in contact with that portion of the surface of the food item which is desired to be browned and/or crispened. The wrapped food item is then exposed to microwave energy. The susceptor material in or on the composite converts a portion of the microwave energy to heat and heats the adjacent surface of the food item by conduction to a sufficiently high temperature to crisp or scorch it. By virtue of absorbing and/or transmitting to the atmosphere liquids evolved during the cooking, the composite materials assist in drying the surface of the food item, thereby enhancing browning and crispening. In the meantime, the microwave energy transmitted through the composite material heats the interior of the food item.

Composites of this invention are illustrated in the following examples. Unless otherwise indicated, the microwave ovens used in experimentation described in the examples were either an Amana "Mastercook" Model RR-1220 (Amana Refrigeration Company, Amana, Iowa, USA) or a Sharp Carousel II Model R-8260 microwave oven (Sharp Electronics Corporation, Paramus, New Jersey, USA.) Both are nominal 700 watt, one cubic foot ovens, and are referred to in the Examples, respectively, as an "Amana microwave oven" and a "Sharp microwave oven".

EXAMPLE 1

Selected fabrics were coated with aluminum paint. One half of the top side of 12"×12" samples of "Kevlar" aramid woven cloth, "Dacron" polyester cloth and glass cloth were lightly spray painted with aluminum spray paint of the type used to cover exhaust systems on automobiles. In each case, one half of the sample was covered with paper, the spray can placed between 20" and 25" from the cloth, and the spray continued for five seconds by hand with a back and forth motion. The coating weights on the fabrics in this example were not measured; however, measurements on similar materials indicate that the coating weights were probably between 756 to 1700 mg/sq. cm dry weight.

The coated aramid cloth was folded over a piece of bread with the metallized portion of the cloth touching the top of the bread and the unmetallized portion touching the bottom. After three minutes in a 550-watt oven, the top side was browned, but the bottom was not.

The coated polyester cloth was folded over a piece of bread and exposed in a microwave oven in the same manner. The cloth puckered up and moved away from the bread, so there was no difference in the appearance of the top and bottom surfaces of the bread. Both sides were a slight buff. This result indicates that contact of the cloth with the surface of some food items is necessary to achieve ideal browning and that the weight of the cloth may therefore be important in maintaining this contact.

The coated fiberglass fabric was wrapped around a hard-crusted roll with the metallized portion contacting the bottom of the roll and the unmetallized portion contacting the top. After three minutes in a 550-watt oven, one could clearly see the line of demarcation between where the metallized portion and the unmetallized portion of the cloth contacted the roll. The bottom was much crisper, harder and darker than the top; the top was not nearly as crisp and hard.

EXAMPLE 2

A single 3½"×3½" slice of fresh regular white enriched bread was wrapped in a single-layer of polyaniline-treated "Dacron" polyester cloth (having a D.C. surface resistivity of 916 ohm/square), placed on a ¼" "Teflon" polytetrafluoroethylene plate (trademark of E. I. du Pont de Nemours and Company, Wilmington, Delaware), and put into an Amana microwave oven operating at full power for 30 seconds. Within ten seconds, steaming was observed. A "Luxtron" probe (Luxtron Fluoroptic(R) Thermometry System, Luxtron Corporation, Mountainview, California, USA) placed between the surface of the bread and the composite material read 99.6 degrees C. at 20 seconds. The product was soft and hot at 30 seconds. The bread overheated and charred at several points from exposure to microwave oven hot spots, but perfect browning occurred otherwise near the fringe. The bread was still moist at a level 1/16" below the surface.

EXAMPLE 3

This example illustrates the use of a composite material comprising coarse cotton coated with dark molasses as susceptor material to wrap and cook egg rolls in a microwave oven. (The molasses used was Brer Rabbit Green Label, Dark Full Flavored, New Orleans Style, All Natural Dark Molasses, distributed by Del Monte Corporation, San Francisco, Calif., USA.) Varying amounts of molasses were coated onto the coarse cotton material, and the resulting material was then wrapped around a commercially available frozen egg roll (Royal-Dragon Chinese Dimsum, spring roll, approximate size 1⅜" diameter, 4½" long). The wrapped egg rolls were placed on a cardboard box stand (3 cm high, 15 cm square with nine 5 cm by 5 cm partitions for moisture to escape from the bottom) in a Sharp microwave oven and cooked at "high" power for the times indicated below in Table 5. As a control, an unwrapped egg roll was cooked under the same circumstances. Observations are presented in TabIe 5.

TABLE 5

| Amt. Molasses on Cotton (mg/cm$^2$) | Cooking Time (Sec.) | Observations |
|---|---|---|
| 20.2 | 140 | Brown, no burning, |

TABLE 5-continued

| Amt. Molasses on Cotton (mg/cm$^2$) | Cooking Time (Sec.) | Observations |
|---|---|---|
| | | not soggy |
| 40.0 | 140 | Brown, no burning, not soggy - best results |
| 56.4 | 150 | Brown, end burned, not soggy |
| 65.3 | 140 | Brown, no burning, not soggy, excess residue burn in cloth |
| None | 140 | Some browning on ends, soggy |

Alternatively, package instructions for the egg rolls suggest cooking for 15 minutes in a 350 deg F. conventional oven.

EXAMPLE 4

This example illustrates the use of a composite material of this invention which has been additionally treated with a liquid flavor enhancing agent, cooking oil. Coarse cotton substrate vacuum metallized with 2% VLT stainless steel 304 was coated with varying amounts of vegetable oil (Wesson Oil, Light & Natural, 100% All Natural Vegetable Oil, by Beatrice Companies, Inc., Fullerton, Calif., USA). The oil-treated composite materials were wrapped around commercially available frozen egg rolls ("Kung Fu" shrimp rolls, Valdez Foods Inc., Philadelphia, Pa., approximate size 1⅜" diameter, 4½" long). The wrapped egg rolls were placed on a cardboard stand as described in Example 3 in a Sharp microwave oven and cooked at "high" power for four minutes each. Several control experiments were also run: an egg roll with no wrapping, an egg roll wrapped in coarse cotton only, an egg roll wrapped in coarse cotton vacuum metallized with 2% VLT equivalent of stainless steel 304, an egg roll wrapped in aluminized polyester film, and an egg roll wrapped in aluminized polyester film in which six ¼" holes have been punched evenly spaced throughout the film. (The aluminized polyester film used in the controls is a commercially utilized microwave susceptor composite material, having been removed from the platform trays for Pillsbury Microwave Pizza, The Pillsbury Company, Minneapolis, Minnesota, USA.) The cooked egg rolls were rated for both browning and crisping on a scale of 1–3, with 1 being poor and 3 being best. These ratings and other observations are presented in Table 6. Alternative means for cooking the frozen egg rolls entails thawing them for at least three hours followed by deep fat frying in 350 deg F. oil for about four minutes.

TABLE 6

| Amt. Oil (mg/cm$^2$) | Browning Scale | Crispness Scale | Observations |
|---|---|---|---|
| 34.0 | 3 | 3 | Very good |
| 39.2 | 3 | 3 | Ends slightly burned |
| 44.0 | 3 | 3 | Very good |
| 48.3 | 3 | 3 | Very good |
| Control-no wrap | 3 | 2 | OK |
| Control-plain cotton | 2 | 1 | Soggy |
| Control-stainless steel metallized cotton, no oil | 2 | 2 | OK |
| Control-alumn. polyester film, no holes | 2 | 2 | Nonuniformly browned |
| Control-alumn. polyester film, six holes | 2 browned | 2 | Nonuniformly |

EXAMPLE 5

A composite material according to this invention was prepared by vacuum metallizing coarse cotton with stainless steel 304 (metal thickness equivalent to 2% VLT). Pieces of composite material were wrapped securely around commercially available pieces of frozen fried chicken (Swanson "Plump and Juicy" Extra Crispy Fried Chicken, Campbell Soup Company, Camden, N.J., USA). The wrapped chicken was placed on a paper plate on a turntable ("Micro-Go-Round Plus", Nordic Ware, Minneapolis, Minn., USA) in an Amana microwave oven and cooked at full power for varying times depending on the piece of chicken:

| | |
|---|---|
| chicken wings | 2 minutes |
| drumsticks | 2 minutes |
| thighs | 3 minutes |
| breast portion | 3.5 minutes |

Good results, i.e., crisp and dry skin, were obtained for these cooking times. In a control experiment, pieces of chicken cooked for the same amounts of time but with no wrapping were found to be greasy and soggy. Alternatively, package instructions for the chicken require 30 minutes in a 375 deg F. conventional oven.

EXAMPLE 6

Coarse cotton cloth vacuum metallized with 2% VLT stainless steel 304 and varying amounts of honey was used to wrap breast portion pieces of the same type of commercially available fried chicken as used in Example 5. (The honey used was Buckwheat "Dutch Gold" Pure Honey, Dutch Gold Honey, Inc., Lancaster, Pennsylvania, USA.) The wrapped pieces were cooked for 3.5 minutes each in a Sharp microwave oven at "high" power, and after cooking, were rated on a scale of 1–3 for browning and crispness. Results are presented in Table 7.

TABLE 7

| Amt. Honey (mg/cm$^2$) | Browning Scale | Crispness Scale | Observations |
|---|---|---|---|
| 42.3 | 2 | 2 | Cloth burned |
| 66.0 | 3 | 3 | Cloth burned |
| 79.3 | 3 | 3 | Cloth burned |

EXAMPLE 7

Commercially available fried chicken breast-portion pieces were securely wrapped in the following materials:

A: coarse cotton, vacuum metallized with 2% VLT stainless steel 304 and coated with 76.9 mg/sq. cm vegetable oil (Wesson brand)

B: coarse cotton, no coatings

C: coarse cotton, coated with 69.3 mg/cm$^2$ vegetable oil (Wesson brand)

D: no wrapping

The wrapped chicken pieces were cooked for four minutes each at "high" power in a Sharp microwave oven Ratings and observations are presented in Table 8. Alternatively, package instructions for the chicken required 30 minutes in a 375 deg F. conventional oven.

TABLE 8

| Sample | Browning Scale | Crispness Scale | Observations |
|---|---|---|---|
| A | 3 | 3 | Good, cloth burned |
| B | 1 | 1 | Very soggy |
| C | 1 | 1 | Soggy |
| D | 2 | 2 | OK |

EXAMPLE 8

A variety of composite materials according to this invention were prepared and used to wrap commercially available frozen egg rolls (Jeno's shrimp and shrimp/meat mini egg rolls, approximate size $1\frac{1}{4}'' \times \frac{3}{8}''$ crossection, $1\frac{3}{8}''$ long). The egg rolls were placed on a turntable in an Amana microwave oven and cooked for the various times indicated in Table 9. All egg rolls so prepared were judged to be acceptable, i.e., their surfaces were brown and crisp and their interior was moist. By way of comparison, egg rolls cooked with no wrap for 45 seconds were soggy and soft and not crisp, and egg rolls cooked with no wrap for 80 seconds were burned and hard outside and dry inside.

TABLE 9

| | Time Cooked in Seconds at a relative coating thickness* of | | |
|---|---|---|---|
| Substrate-Susceptor | 63 ohm/sq | 125 ohm/sq | 250 ohm/sq |
| Coarse cotton - SS304 | 61–64 | 55–63 | 60–70 |
| "Kevlar" - SS304 | 55–59 | 55–80 | 60–70 |
| Glass Fiber - SS304 | 55–58 | 55–80 | 55–80 |
| "Dacron" - SS304 | 50–60** | — | — |
| Crse. Cotton - Al | 45–50 | 50–55 | 50–55 |
| Crse. Cotton - Mu-metal | fabric burned | 45 | 40–45 |
| Crse. Cotton - Perm-alloy | " | 45 | 50–55 |

*Thickness equivalent to that on polyester film which would provide the indicated resistivities.

**Fabric melted at corner points at 55 seconds.

EXAMPLE 9

The experiment of Example 8 was repeated except that, as the composite susceptor material, substrates treated with a dispersion of aluminum flakes in a polyester copolymer medium were used. In Example 9A, a coating of circular aluminum flakes ("Y" flakes, Kansai Paint Company, Hiratsuka, Japan) in a polyester copolymer medium was applied to a paper towel with a 2-mil doctor knife. In Example 9B, fine cotton was gravure printed with a dispersion of aluminum flakes (Silberline 3641, Silberline Manufacturing Co., Lansford, PA, USA) with two passes of a #33 Trihelical engraving roll for a total of 2.5 mg/sq. cm dry coating weight. Egg rolls wrapped in the susceptor material of Example 9A were cooked acceptably (i.e., brown and crisp surface, moist interior) in an Amana microwave oven within 60–80 seconds. Egg rolls wrapped in the susceptor material of Example 9B were cooked acceptably in the same oven in 90–110 seconds.

What is claimed is:

1. A composite material for wrapping around a food item to be cooked in a microwave oven comprising a drapable, liquid permeable, woven or non-woven, fibrous, dielectric substrate, which substrate, or fibers of which substrate, are coated and/or imbibed with one or more microwave susceptor materials, the amount of said susceptor materials being sufficient to generate adequate heat to rapidly brown or crispen the surface of food item adjacent thereto without substantially impeding the ability of the microwave energy to penetrate the susceptor material and cook the food item, said composite material being liquid permeable.

2. Composite material according to claim 1 capable of absorbing or transmitting a substantial portion of the moisture evolved at the surface of the wrapped food item during cooking of said item, thereby enhancing the browning and crispening of the surface of said item.

3. Composite material according to claim 2 where said susceptor materials are selected from aluminum, stainless steel, nickel/iron/molybdenum alloys and nickel/iron/copper alloys.

4. Composite material according to claim 2 where said susceptor materials are selected from mono- and poly-saccharides and ionically conductive flavor agents.

5. Composite material according to claim 2 where said susceptor material is aluminum flake.

6. Composite material according to claim 2 where said composite material is coated or imbibed with an aroma or flavor enhancing agent.

7. Composite material according to claim 1 which exhibit a moisture takeup of at least 0.5 mg/sq. cm and a moisture transmission rate of at least 50 mg/sq. cm/minute.

8. Composite material according to claim 1 which exhibit a moisture takeup of at least 1.0 mg/sq. cm and a moisture transmission rate of at least 200 mg/sq. cm/minute.

9. Composite material according to claim 1 where said substrate is made from fibers selected from cotton, cellulose, jute, hemp, acetate, fiberglass, nylon, polyester, aramid, polypropylene and other polyolefins.

10. Composite material according to claim 1 where said substrate is paper or a woven cotton or fiberglass fabric.

11. Composite material according to claim 1 where stainless steel, nickel/iron/molybdenum alloys and nickel/iron/copper alloys.

12. Composite material according to claim 1 where said susceptor materials are selected from mono- and poly-saccharides and ionically conductive flavor agents.

13. Composite material according to claim 1 where said susceptor material is aluminum flake.

14. Composite material according to claim 1 where said composite material is coated or imbibed with an aroma or flavor enhancing agent.

15. The composite materials of claim 1 wrapped around the food item of claim 1.

* * * * *

UNITED STATES PATENT AND TRADEMARK OFFICE

CERTIFICATE OF CORRECTION

PATENT NO. : 4,892,782

DATED : January 9, 1990

INVENTOR(S) : John Richard Fisher
Hua-Feng Huang

It is certified that error appears in the above—identified patent and that said Letters Patent is hereby corrected as shown below:

In the Claims:

Claim 11, line 1, after "where" insert --said susceptor materials are selected from aluminum--

Signed and Sealed this

Fifth Day of February, 1991

*Attest:*

HARRY F. MANBECK, JR.

*Attesting Officer*

*Commissioner of Patents and Trademarks*